US008519809B1

(12) United States Patent
Fu

(10) Patent No.: US 8,519,809 B1
(45) Date of Patent: Aug. 27, 2013

(54) MEMS ELECTRICAL SWITCH

(75) Inventor: Yee-Chung Fu, Fremont, CA (US)

(73) Assignee: Advanced NuMicro Systems, Inc., San Jose, CA (US)

( * ) Notice: Subject to any disclaimer, the term of this patent is extended or adjusted under 35 U.S.C. 154(b) by 52 days.

(21) Appl. No.: 13/042,333

(22) Filed: Mar. 7, 2011

(51) Int. Cl.
*H01H 51/22* (2006.01)

(52) U.S. Cl.
USPC ..... 335/78; 200/181

(58) Field of Classification Search
USPC ..... 335/78; 200/181
See application file for complete search history.

(56) References Cited

U.S. PATENT DOCUMENTS

| | | | | |
|---|---|---|---|---|
| 6,384,353 | B1 | 5/2002 | Huang et al. | |
| 6,506,989 | B2 * | 1/2003 | Wang | 200/181 |
| 6,587,021 | B1 * | 7/2003 | Streeter | 333/262 |
| 6,713,367 | B2 * | 3/2004 | Solgaard et al. | 438/459 |
| 6,744,173 | B2 * | 6/2004 | Behin et al. | 310/309 |
| 6,757,140 | B1 * | 6/2004 | Hawwa | 360/294.5 |
| 6,798,315 | B2 | 9/2004 | Schaefer | |
| 6,809,907 | B1 * | 10/2004 | Vigna et al. | 360/294.3 |
| 7,501,911 | B2 | 3/2009 | Hong et al. | |
| 7,619,497 | B2 * | 11/2009 | Yuba et al. | 335/78 |
| 2004/0004520 | A1 * | 1/2004 | Giousouf et al. | 331/154 |
| 2006/0145793 | A1 * | 7/2006 | Ning et al. | 335/78 |
| 2007/0176715 | A1 * | 8/2007 | Nakanishi | 335/78 |

* cited by examiner

*Primary Examiner* — Bernard Rojas
(74) *Attorney, Agent, or Firm* — Patent Law Group LLP; David C. Hsia

(57) ABSTRACT

A micro-electromechanical (MEMS) switch includes a substrate, stationary actuator comb teeth extending from a stationary actuator pad supported above the substrate, stationary contact comb teeth extending from a stationary contact pad supported above the substrate, and a body suspended over the substrate for rotation about an axis perpendicular to the substrate. The body includes movable actuator comb teeth interdigitated in-plane with the stationary actuator comb teeth where the shortest distance between adjacent movable and stationary actuator comb teeth has a first value. The body further includes movable contact comb teeth interdigitated in-plane with the stationary contact comb teeth where the shortest distance between adjacent movable and stationary contact comb teeth has a second value smaller than the first value.

17 Claims, 3 Drawing Sheets

MEMS ELECTRICAL SWITCH

FIELD OF INVENTION

This invention relates to a micro-electromechanical (MEMS) switch.

DESCRIPTION OF RELATED ART

MEMS electrical switches are an alternative to solid state and electromagnetic relay switches. MEMS electrical switches may be used in phase shifters, smart antennas, cell phones, and switchable filters.

SUMMARY

In one embodiment of the invention, a micro-electromechanical (MEMS) switch includes a substrate, stationary actuator comb teeth extending from a stationary actuator pad supported above the substrate, stationary contact comb teeth extending from a stationary contact pad supported above the substrate, and a body suspended over the substrate for rotation about an axis perpendicular to the substrate. The body includes movable actuator comb teeth interdigitated in-plane with the stationary actuator comb teeth where the shortest distance between adjacent movable and stationary actuator comb teeth has a first value. The body further includes movable contact comb teeth interdigitated in-plane with the stationary contact comb teeth where the shortest distance between adjacent movable and stationary contact comb teeth has a second value smaller than the first value.

BRIEF DESCRIPTION OF THE DRAWINGS

In the drawings.

Use of the same reference numbers in different figures indicates similar or identical elements.

DETAILED DESCRIPTION OF THE INVENTION

Figure 1A:
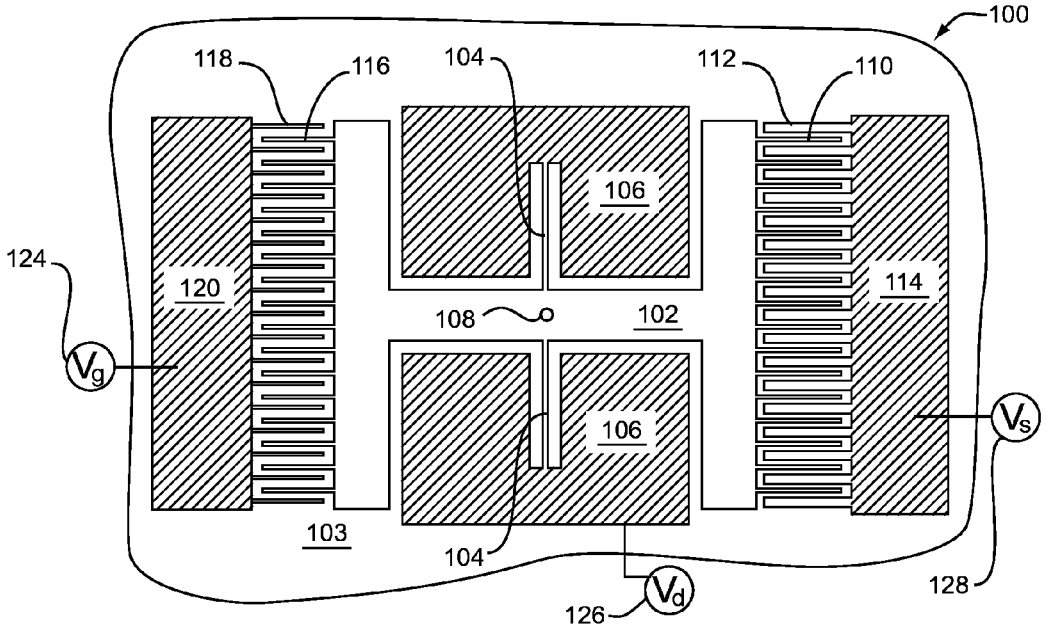
FIG. 1A illustrates a MEMS electrical switch in an off state in one or more embodiments of the present disclosure.
Figure 1B:
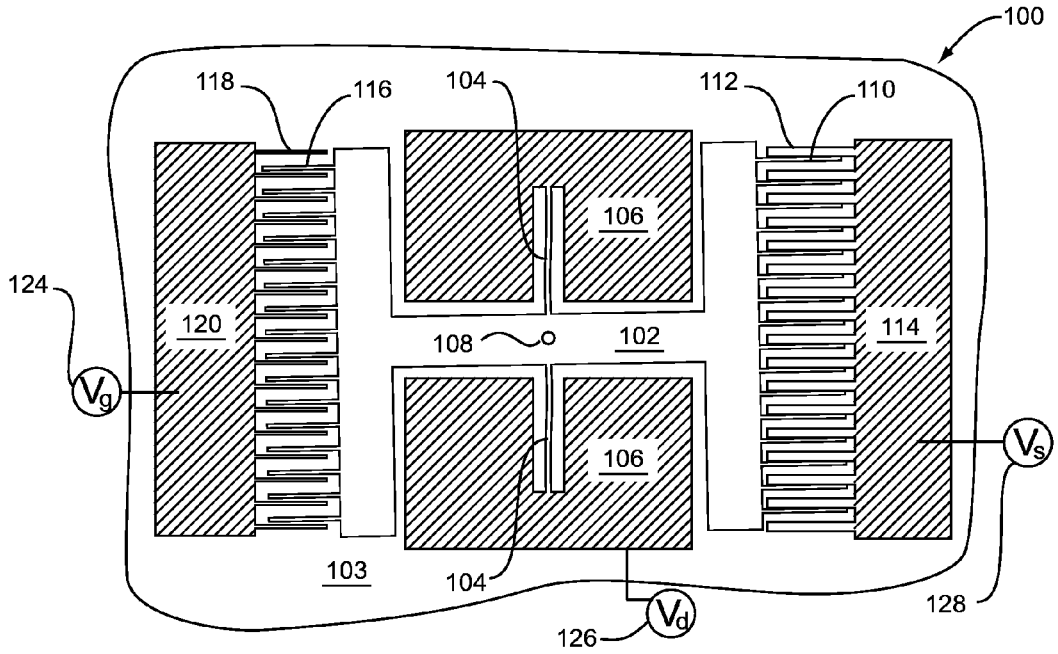
FIG. 1B illustrates the MEMS electric switch of FIG. 1 in an on state in one or more embodiment of the present disclosure.

FIGS. 1A and 1B illustrate a MEMS electrical switch 100 in an off state and an on state, respectively, in one or more embodiments of the present disclosure. Switch 100 can be made using typical semiconductor manufacturing processes.

Switch 100 includes a body 102 suspended above a substrate 103 by springs 104 extending from stationary spring pads 106, which are located above the substrate. Body 102 may have an I-shape where stationary spring pads 106 are nested on the two sides of the web. Springs 104 may be rectangular beams having a small cross-section. The attachment points of springs 104 allows body 102 to rotate about an axis 108 perpendicular to substrate 103.

At one end of body 102, movable contact comb teeth 110 (only one is labeled) extend out from one flange. Movable contact comb teeth 110 are interdigitated in-plane with stationary contact comb teeth 112 (only one is labeled) extending from a stationary contact pad 114, which is located above substrate 103. In one embodiment, adjacent movable and stationary contact comb teeth 110 and 112 are parallel and the shortest distance between them is substantially a distance A. In other words, movable and stationary contact comb teeth 110 and 112 have a substantially uniform gap A between their opposing vertical surfaces. In this embodiment, movable contact comb teeth 110 may have a smaller cross-section than stationary contact comb teeth 112 so the movable contact comb teeth may flex to contact the stationary contact comb teeth substantially along their length. In the figures, hatched areas are stationary.

At another end of body 102, movable actuator comb teeth 116 extend out from the other flange. Movable actuator comb teeth 116 are interdigitated in-plane with stationary actuator comb teeth 118 extending from a stationary actuator pad 120, which is located above substrate 103. Together movable and stationary actuator comb teeth 116 and 118 form an actuator for rotating body 102. In one embodiment, adjacent movable and stationary actuator comb teeth 116 and 118 are parallel and the shortest distance between them is substantially a distance B, which is larger than distance A. In other words, movable and stationary actuator comb teeth 116 and 118 have a substantially uniform gap B between their opposing vertical surfaces. In this embodiment, inherent asymmetry in movable and stationary actuator comb teeth 116 and 118 allows the actuator to rotate body 102 in one direction with electrostatic force when they experience a voltage/electrical potential difference as shown in FIG. 1B. Inherent asymmetry is introduced by the manufacturing process of switch 100. In other embodiments, intentional asymmetry is introduced by design to control the rotational direction of body 102. For example, each movable actuator comb tooth 116 may have substantially uniform gap B with an adjacent stationary actuator comb tooth 118 on its left side and a larger substantially uniform gap C with an adjacent stationary actuator comb tooth 118 on its right side to rotate body 102 in a counterclockwise direction as shown in FIG. 1B.

Stationary contact pad 114 may serve as or be coupled to a source terminal of switch 100, one stationary spring pad 106 may serve as or be coupled to a drain terminal of the switch, and actuator pad 120 may serve as or be coupled to a gate terminal of the switch. The role of stationary contact pad 114 and stationary spring pad 106 may be reversed. The voltage/electrical potential difference between movable actuator comb teeth 116 and stationary actuator comb teeth 118 may be provided by a voltage source 124 supplying a gate voltage/electrical potential Vg directly or indirectly to stationary actuator pad 120, and a voltage source 126 supplying a drain voltage/electrical potential Vd directly or indirectly to stationary spring pad 106. Voltage sources 124 may represent circuitry separate from switch 100 in a larger device, such as a phase shifter, a smart antenna, a cell phone, or a switchable filter. Voltage source 126 may represent circuitry downstream from switch 100 in the larger device.

When movable actuator comb teeth 116 and stationary actuator comb teeth 118 rotate body 102, movable contact comb teeth 110 and stationary contact comb teeth 112 come into contact to close a circuit from one switch terminal to the other (e.g., from pad 114 to pad 106). A voltage source 128 may supply a source voltage/electrical potential Vs to stationary contact pad 114 to create a current from the source terminal to the drain terminal. Voltage source 128 may represent circuitry upstream from switch 100 in the larger device.

Figure 2A:
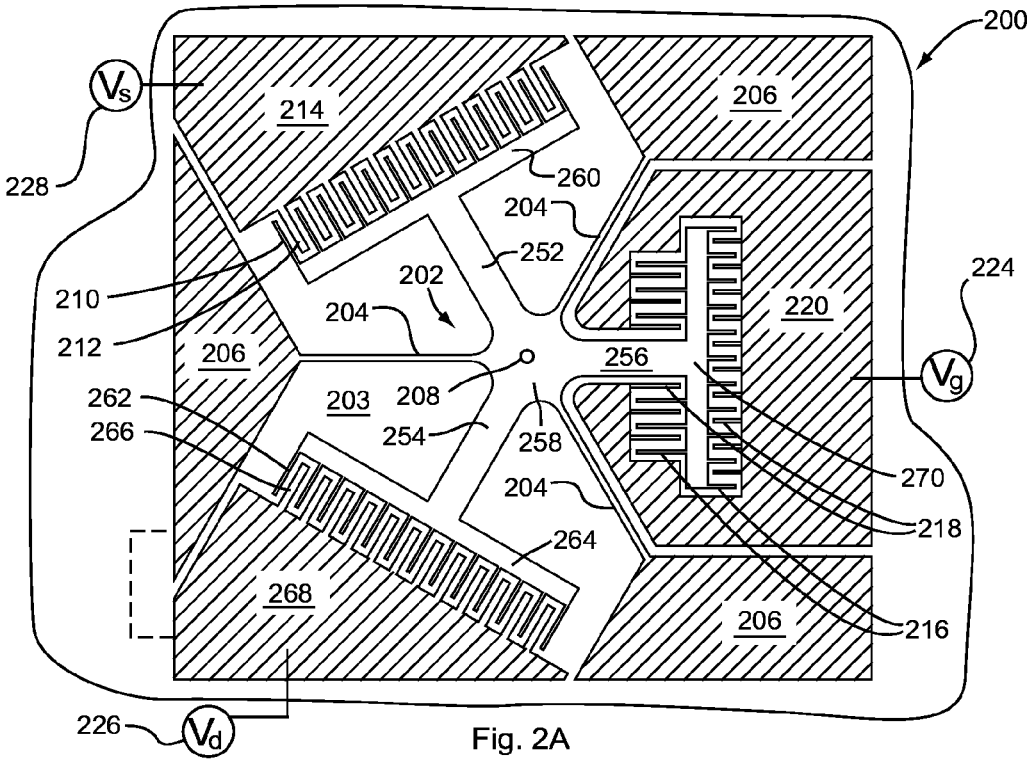
FIG. 2A illustrates a MEMS electrical switch in an off state in one or more embodiments of the present disclosure.
Figure 2B:
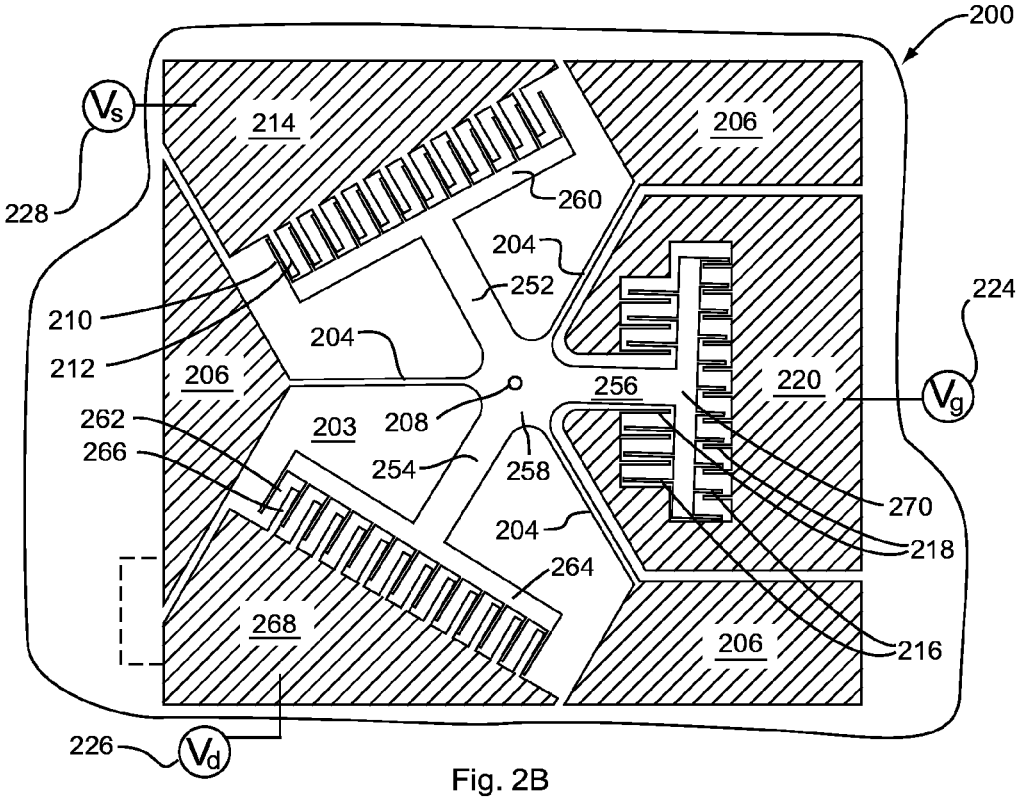
FIG. 2B illustrates the MEMS electrical of FIG. 2A in an on state in one or more embodiments of the present disclosure.

FIGS. 2A and 2B illustrate a MEMS electrical switch 200 in an off state and an on state, respectively, in one or more embodiments of the present disclosure. Switch 200 can be made using typical semiconductor manufacturing processes.

Switch 200 includes a body 202 suspended above a substrate 203 by springs 204 extending from stationary spring pads 206, which are located above the substrate. Body 202 includes a number of contact and actuator spokes. For example, body 202 includes a first contact spoke 252, a second contact spoke 254, and an actuator spoke 256 extending radially from a hub 258. Spokes 252, 254, and 256 may be evenly spaced around hub 258. Springs 204 may be rectangular beams having a small cross-section. The attachment points of springs 204 to hub 258 allow body 202 to rotate about an axis 208 perpendicular to substrate 203. Springs 204 may be evenly spaced around hub 258 where each is located between two spokes.

At the end of first contact spoke 252, movable contact comb teeth 210 extend from a tangent member 260 to the spoke. Movable contact comb teeth 210 are interdigitated in-plane with stationary contact comb teeth 212 extending from a stationary contact pad 214, which is located above substrate 203. In one embodiment, adjacent movable and stationary contact comb teeth 210 and 212 are parallel and the shortest distance between them is substantially a distance A. In other words, movable and stationary contact comb teeth 210 and 212 have a substantially uniform gap A between their opposing vertical surfaces. In this embodiment, movable contact comb teeth 210 may have a smaller cross-section than stationary contact comb teeth 212 so the movable contact comb teeth may flex to contact the stationary contact comb teeth substantially along their length.

At the end of second contact spoke 254, movable contact comb teeth 262 extend from a tangent member 264 to the spoke. Movable contact comb teeth 262 are interdigitated in-plane with stationary contact comb teeth 266 extending from a stationary contact pad 268, which is located above substrate 203. In one embodiment, adjacent movable and stationary contact comb teeth 262 and 266 are parallel and the shortest distance between them is substantially distance A. In other words, movable and stationary contact comb teeth 262 and 266 have a substantially uniform gap A between their opposing vertical surfaces. In this embodiment, movable contact comb teeth 262 may have a smaller cross-section than stationary contact comb teeth 266 so the movable contact comb teeth may flex to contact the stationary contact comb teeth substantially along their length.

At the end of actuator spoke 254, movable actuator comb teeth 216 extend out from opposite sides of a tangent member 270 to the spoke. Movable actuator comb teeth 216 are interdigitated in-plane with stationary actuator comb teeth 218 extending from a stationary actuator pad 220, which is located above substrate 203. Together movable and stationary actuator comb teeth 216 and 218 form an actuator for rotating body 202. In one embodiment, adjacent movable and stationary actuator comb teeth 216 and 218 are parallel and the shortest distance between them is substantially distance B, which is larger than distance A. In other words, movable and stationary actuator comb teeth 216 and 218 have a substantially uniform gap B between their opposing vertical surfaces. In this embodiment, inherent asymmetry in movable and stationary actuator comb teeth 216 and 218 allows the actuator to rotate body 202 in one direction with electrostatic force when they experience a voltage/electrical potential difference as shown in FIG. 2B. Inherent asymmetry is introduced by the manufacturing process of switch 200. In other embodiments, intentional asymmetry is introduced by design to control the rotational direction of body 202. For example, each movable actuator comb tooth 216 may have substantially uniform gap B with an adjacent stationary actuator comb tooth 218 on its left side and a larger substantially uniform gap C with an adjacent stationary actuator comb tooth 218 on its right side to rotate body 202 in a clockwise direction as shown in FIG. 2B.

Stationary contact pad 214 may serve as or be coupled to a source terminal of switch 200, stationary contact pad 268 may serve as or be coupled to a drain terminal of the switch, and stationary actuator pad 220 may serve as or be coupled to a gate terminal of the switch. The role of stationary contact pads 214 and 268 may be reversed. The voltage/electrical potential difference between movable actuator comb teeth 216 and stationary actuator comb teeth 218 may be provided by a voltage source 224 supplying gate voltage/electrical potential Vg directly or indirectly to stationary actuator pad 220, and another voltage source supplying a bias voltage/electrical potential directly or indirectly to a stationary spring pad 206. In one embodiment, stationary spring pad 206 is coupled to stationary contact pad 268, which directly or indirectly receives drain voltage/electrical potential Vd from a voltage source 226. In another embodiment, stationary spring pad 206 is coupled to stationary contact pad 214, which directly or indirectly receives source voltage/electrical potential Vs from a voltage source 228. In yet another embodiment, stationary spring pad 206 is floated to an arbitrary voltage/electrical potential different from gate voltage/electrical potential Vd. Voltage sources 224 may represent circuitry separate from switch 100 in a larger device, such as a phase shifter, a smart antenna, a cell phone, or a switchable filter. Voltage sources 226 and 228 may represent circuitry downstream and upstream from switch 200 in the larger device.

When movable actuator comb teeth 216 and stationary actuator comb teeth 218 rotate hub 258, movable and stationary contact comb teeth 210 and 212 come into contact, as well as movable and stationary contact comb teeth 262 and 266, to close a circuit from one switch terminal to the other (e.g., from pad 214 to pad 268). Voltage source 228 may supply source voltage/electrical potential Vs to stationary contact pad 214 to create a current from the source terminal to the drain terminal.

Figure 3:
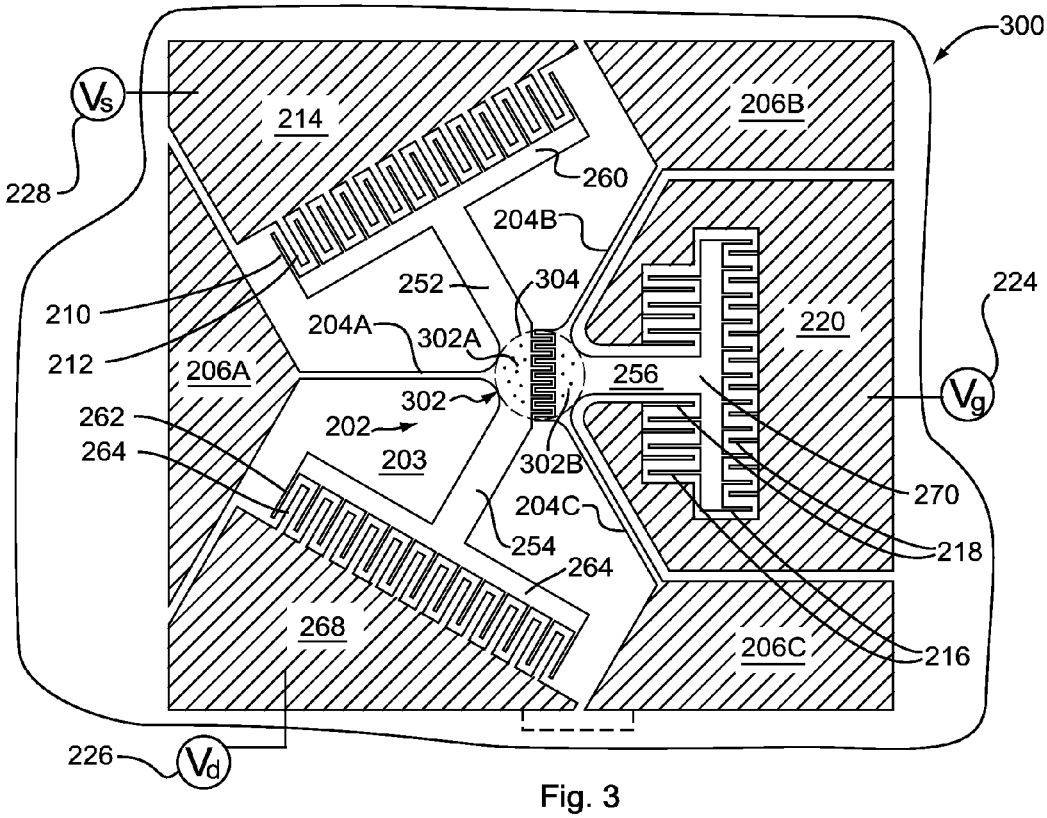
FIG. 3 illustrates a variation of the MEMS electric switch of FIGS. 2A and 2B in one or more embodiments of the present disclosure.

FIG. 3 illustrates a MEMS electrical switch 300 in an off state in one or more embodiments of the present disclosure. Switch 300 is a variation of switch 200 and can be made using typical semiconductor manufacturing processes.

In switch 300, a hub 302 consists of two electrically insulated halves 302A and 302B held together by an insulator 304 (shown in phantom), such as silicon oxide, so the hub rotates as one unit. Hub halves 302A and 304B may have interlocking features, such as intertwined fingers, and insulator 304 may be formed between the interlocking features as well as on top or below other portions of the hub halves. Hub half 302A is connected to contact spokes 252 and 254, and by a spring 204A to a stationary spring pad 206A. Hub half 302B is connected to actuator spoke 256, and by springs 204B and 204C to stationary spring pads 206B and 206C, respectively.

As before, voltage source 224 provides gate voltage/electrical potential Vg to stationary actuator comb teeth 218. However, in one embodiment, stationary spring pad 206B or 206C is coupled to stationary contact pad 268, which directly or indirectly receives drain voltage/electrical potential Vd from voltage source 226. In another embodiment, stationary spring pad 206B or 206C is coupled to stationary contact pad 214, which directly or indirectly receives source voltage/electrical potential Vs from voltage source 228. In yet another embodiment, stationary spring pad 206B or 206C is floated to an arbitrary voltage/electrical potential different from gate voltage/electrical potential Vg. As hub halves 302A and 302B are electrically insulated from each other, any current loss that may result from contact pad 214 to spring pad 206 in FIG. 2B is avoided. The same concept may be applied to switch 100 in FIGS. 1A and 1B to separate body 102 into two insulated halves.

Various other adaptations and combinations of features of the embodiments disclosed are within the scope of the invention. For example in the above switches, the stationary contact comb teeth may be angled so the movable contact comb teeth become parallel to the stationary contact comb teeth when they contact as the body rotates. During the off state of the switch, the shortest distance from a tip of each stationary contact comb tooth to a movable contact comb tooth on one side would be about distance A so the contact comb teeth would touch before the actuator comb teeth. Numerous embodiments are encompassed by the following claims.

The invention claimed is:

1. A micro-electromechanical switch, comprising:

a substrate;

stationary actuator comb teeth extending from a stationary actuator pad above the substrate;

stationary contact comb teeth extending from a stationary contact pad above the substrate; and a body suspended above the substrate for rotation about an axis perpendicular to the substrate, the body comprising:

movable actuator comb teeth interdigitated in-plane with the stationary actuator comb teeth, wherein a shortest distance between adjacent movable and stationary actuator comb teeth has a first value; and movable contact comb teeth interdigitated in-plane with the stationary contact comb teeth, wherein a shortest distance between adjacent movable and stationary contact comb teeth has a second value smaller than the first value.

2. The switch of claim 1, further comprising:

stationary spring pads coupled by springs to suspend the body above the substrate for rotation, wherein the stationary contact pad is a first terminal of the switch, one of the stationary spring pads is a second terminal for the switch, and the stationary actuator pad is a gate terminal of the switch.

3. The switch of claim 2, further comprising:

a first voltage source coupled to the stationary actuator pad;

a second voltage source coupled to said one of the stationary spring pads; and wherein the first voltage source generates a higher electrical potential than the second voltage source to rotate the body so the movable and stationary contact comb teeth touch to close a circuit between the first and the second terminals.

4. The switch of claim 3, further comprising:

a third voltage source coupled to the stationary contact pad to create a current between the first and the second terminals.

5. The switch of claim 1, further comprising:

stationary spring pads coupled by springs to suspend the body above the substrate for rotation; and other stationary contact comb teeth extending from an other stationary contact pad above the substrate.

6. The switch of claim 5, wherein the body further comprises other movable contact comb teeth interdigitated in-plane with the other stationary contact comb teeth, wherein a shortest distance between adjacent other movable and other stationary contact comb teeth has the second value.

7. The switch of claim 6, wherein the stationary contact pad is a first terminal of the switch, the other stationary contact pad is a second terminal for the switch, and the stationary actuator pad is a gate terminal.

8. The switch of claim 7, further comprising:

a first voltage source coupled to the contact stationary pad; and a second voltage source coupled to the other contact stationary pad to create a current between the first and the second terminals.

9. The switch of claim 8, further comprising:

a third voltage source coupled to the stationary actuator pad; and wherein one of the stationary spring pads is coupled to the stationary contact or the other stationary contact pad, wherein the third voltage source generates a higher electrical potential than the first or the second voltage source to rotate the body so the movable and the stationary contact comb teeth touch and the other movable and the other stationary contact comb teeth touch to close a circuit between the first and the second terminals.

10. The switch of claim 7, wherein the body comprises a hub and the movable actuator comb teeth, the movable contact comb teeth, and the other movable contact comb teeth are respectively located at ends of an actuator spoke, a first contact spoke, and a second contact spoke that extend from the hub.

11. The switch of claim 10, wherein the hub comprises two electrically insulated first and second hub halves, the actuator spoke and one of the springs extending from the first hub half, and the first and the second contact spokes extending from the second hub half.

12. The switch of claim 11, further comprising:

a first voltage source coupled to the contact stationary pad; and a second voltage source coupled to the other contact stationary pad to create a current between the first and the second terminals.

13. The switch of claim 12, further comprising:

a third voltage source coupled to the stationary actuator pad; and wherein said one of the stationary spring pads coupled to said one of the springs is coupled to the stationary contact or the other stationary contact pad, wherein the third voltage source generates a higher electrical potential than the first or the second voltage source to rotate the body so the movable and the stationary contact comb teeth touch and the other movable and the other stationary contact comb teeth touch to close a circuit between the first and the second terminals.

14. A method for operating a switch, comprising:

providing a first electrical potential to stationary actuator comb teeth extending from a stationary actuator pad above a substrate;

providing a second electrical potential to movable actuator comb teeth from a body to cause a rotation of the body, the movable actuator comb teeth being interdigitated in plane with the stationary actuator comb teeth, the body being suspended over the substrate by springs coupled to stationary spring pads for rotation about an axis perpendicular from the substrate, and a shortest distance between adjacent movable and stationary actuator comb teeth has a first value; and providing a third electrical potential to stationary contact comb teeth extending from a stationary contact pad above the substrate, wherein the stationary contact comb teeth are interdigitated in-plane with movable contact comb from the body, and a shortest distance between adjacent movable and stationary contact comb teeth have a second value smaller than the first value.

15. The method of claim 14, wherein:

the stationary contact pad is a first terminal of the switch, one of the stationary spring pads is a second terminal for the switch, and the stationary actuator pad is a gate terminal of the switch;

providing the second electrical potential to movable actuator comb teeth comprises providing the second electrical potential to said one of the stationary spring pads; and the rotation of the body causes the movable and stationary contact comb teeth to touch and close a circuit between the first and the second terminals.

16. The method of claim 14, wherein:

other stationary contact comb teeth extend from an other stationary contact pad above the substrate, the other stationary contact pad being electrically coupled to said one of the stationary spring pads;

the body further comprises other movable contact comb teeth interdigitated in-plane with the other stationary contact comb teeth;

a shortest distance between adjacent other movable and other stationary contact comb teeth has the second value;

the stationary contact pad is a first terminal of the switch, the other stationary contact pad is a second terminal for the switch, and the stationary actuator pad is a gate terminal of the switch;

providing the second electrical potential to movable actuator comb teeth comprising providing the second electrical potential to the other stationary contact pad; and the rotation of the body causes the movable and stationary contact comb teeth and the other movable and the other stationary contact comb teeth to touch and close a circuit between the first and the second terminals.

17. The method of claim 16, wherein said one of the stationary spring pads is electrically insulated from the stationary contact pad and the other stationary contact pad.

* * * * *